US009597541B2

(12) United States Patent
Hinds et al.

(10) Patent No.: US 9,597,541 B2
(45) Date of Patent: Mar. 21, 2017

(54) SUSPENSION TRAINING EXERCISE DEVICE

(75) Inventors: Jon Hinds, Madison, WI (US); Glenn Polinsky, Waunakee, WI (US); Ray Rollins, Verona, WI (US); Kevin Dorsey, Madison, WI (US)

(73) Assignee: PIVOTAL 5, LLC, Chicago, IL (US)

( * ) Notice: Subject to any disclaimer, the term of this patent is extended or adjusted under 35 U.S.C. 154(b) by 345 days.

(21) Appl. No.: 13/818,251

(22) PCT Filed: Aug. 23, 2011

(86) PCT No.: PCT/US2011/048814

§ 371 (c)(1),
(2), (4) Date: Mar. 11, 2013

(87) PCT Pub. No.: WO2012/027371

PCT Pub. Date: Mar. 1, 2012

(65) Prior Publication Data

US 2013/0217547 A1 Aug. 22, 2013

Related U.S. Application Data

(60) Provisional application No. 61/376,446, filed on Aug. 24, 2010, provisional application No. 61/429,486, filed on Jan. 4, 2011.

(51) Int. Cl.
*A63B 21/068* (2006.01)
*A63B 71/00* (2006.01)
(Continued)

(52) U.S. Cl.
CPC ..... *A63B 21/068* (2013.01); *A63B 7/00* (2013.01); *A63B 21/00185* (2013.01);
(Continued)

(58) Field of Classification Search
CPC ..... A63B 21/00; A63B 21/06; A63B 21/068; A63B 21/065; A63B 21/1469;
(Continued)

(56) References Cited

U.S. PATENT DOCUMENTS 735,065 A 8/1903 Chellis et al.
3,565,424 A 2/1971 Macabet et al.
(Continued)

*Primary Examiner* — Stephen Crow
*Assistant Examiner* — Garrett Atkinson
(74) *Attorney, Agent, or Firm* — Ladas & Parry LLP

(57) ABSTRACT

A suspension training device includes at least one training unit having a support strap extending between a grip and a mounting end, whereby the mounting end can be mounted to a structure (such as a ceiling, door, post, etc.) so that the support strap and grip extend therefrom. The mounting end bears a mounting button which may be removably inserted into an aperture in the support strap, whereby the mounting end of the support strap may be wrapped about an object and the mounting button may be inserted in the aperture to mount the support strap to the object. The grip bears a handle with an arch extending therefrom. A user can easily grasp the handle with his/her hands, or engage a foot within the arch, when performing suspension training exercises.

26 Claims, 3 Drawing Sheets

(51) Int. Cl.
*A63B 7/00* (2006.01)
*A63B 21/00* (2006.01)
*A63B 21/16* (2006.01)
*A63B 23/12* (2006.01)

(52) U.S. Cl.
CPC ..... *A63B 21/16* (2013.01); *A63B 21/4035* (2015.10); *A63B 21/4043* (2015.10); *A63B 23/1236* (2013.01); *A63B 2225/09* (2013.01)

(58) Field of Classification Search
CPC ..... A63B 21/1484; A63B 21/00185; A63B 21/16; A63B 21/1236
USPC ..... 482/91–96, 139
See application file for complete search history.

(56) References Cited

U.S. PATENT DOCUMENTS 3,858,874 A 1/1975 Weider
4,125,257 A 11/1978 Lew
4,337,938 A * 7/1982 Rodriguez ..... A63B 69/0059 224/258
4,403,773 A 9/1983 Swann
4,529,191 A * 7/1985 Miller ..... A63B 1/00 211/123
4,606,539 A * 8/1986 Farnham ..... A63B 21/0023 482/148
4,685,671 A * 8/1987 Hagerman ..... A63B 21/04 482/124
4,756,527 A 7/1988 Ledbetter
4,949,888 A * 8/1990 May ..... F42B 39/02 2/328
4,982,885 A * 1/1991 Severson ..... A45C 13/30 224/250
5,100,129 A 3/1992 Porter
5,112,287 A * 5/1992 Brewer ..... A63B 21/04 482/123
5,176,602 A 1/1993 Roberts
5,209,712 A 5/1993 Ferri
5,256,119 A * 10/1993 Tudor ..... A63B 23/04 128/882
D343,881 S 2/1994 Wilson
5,411,460 A * 5/1995 Karlson ..... A63B 21/00072 482/112
5,433,688 A 7/1995 Davies
5,514,057 A 5/1996 Ciolino
5,556,369 A * 9/1996 Roberts ..... A63B 21/4017 482/131
5,558,609 A 9/1996 Olschansky et al.
5,637,067 A * 6/1997 Ausmus ..... A63B 21/0004 482/140
5,885,190 A 3/1999 Reiter
5,921,903 A * 7/1999 Lawrence ..... A63B 23/0211 482/131
5,944,640 A 8/1999 Larrson
6,070,309 A * 6/2000 Wong ..... A41F 3/02 24/668
6,328,679 B1 12/2001 Croft
6,371,343 B1 4/2002 D'Souza
6,390,957 B1 5/2002 Knight
6,402,668 B1 * 6/2002 Harker ..... A63B 21/0728 482/107
6,497,641 B1 * 12/2002 Hinds ..... A63B 21/00043 482/121
6,514,163 B2 * 2/2003 Burns ..... A63B 21/00185 473/422
6,652,419 B1 11/2003 Rota
6,692,415 B1 * 2/2004 Winston ..... A63B 21/0004 482/122
6,764,433 B1 * 7/2004 Sims ..... A63B 21/0552 482/139
6,921,354 B1 7/2005 Shifferaw
6,941,620 B1 9/2005 Hinds
7,044,896 B2 * 5/2006 Hetrick ..... A63B 21/00043 482/114
7,090,622 B2 8/2006 Hetrick
7,438,674 B2 10/2008 Sjodin
D593,167 S 5/2009 Vigilia
7,651,448 B2 1/2010 Hetrick
7,722,508 B2 5/2010 Hetrick
7,762,932 B2 7/2010 Hetrick
7,785,244 B2 8/2010 Hetrick
7,806,814 B2 10/2010 Hetrick
7,819,784 B1 10/2010 Caswell et al.
7,892,157 B2 2/2011 Arnett
8,007,413 B1 * 8/2011 Wu ..... A63B 21/068 482/131
8,066,625 B2 * 11/2011 Scheiman ..... A63B 71/0009 482/139
8,152,703 B1 * 4/2012 Hinds ..... A63B 21/00065 482/122
8,348,814 B1 * 1/2013 Hinds ..... A63B 7/02 482/82
8,573,458 B1 * 11/2013 Hamilton ..... A45F 5/021 224/250
2002/0022555 A1 * 2/2002 Nesci ..... A63B 21/0552 482/91
2005/0054497 A1 * 3/2005 Hull ..... A63B 21/4013 482/110
2005/0085350 A1 * 4/2005 Shen ..... A63B 23/00 482/91
2007/0027005 A1 2/2007 Hetrick
2007/0066450 A1 3/2007 Hetrick
2007/0142185 A1 * 6/2007 Woodman ..... A47D 13/046 482/69
2007/0173383 A1 * 7/2007 Feigenbaum ..... A63B 21/1663 482/91
2009/0054215 A1 2/2009 McBride et al.
2009/0075787 A1 3/2009 Hetrick
2009/0075788 A1 3/2009 Hetrick
2009/0075789 A1 3/2009 Hetrick
2009/0075790 A1 3/2009 Hetrick
2009/0075794 A1 3/2009 Hetrick
2009/0105053 A1 * 4/2009 Hetrick ..... A63B 21/0023 482/133
2009/0275449 A1 11/2009 Terry
2010/0016132 A1 * 1/2010 Flynn ..... A63B 21/0004 482/122
2010/0204023 A1 8/2010 Mills et al.
2013/0123080 A1 * 5/2013 Failer ..... A63B 21/008 482/139

* cited by examiner

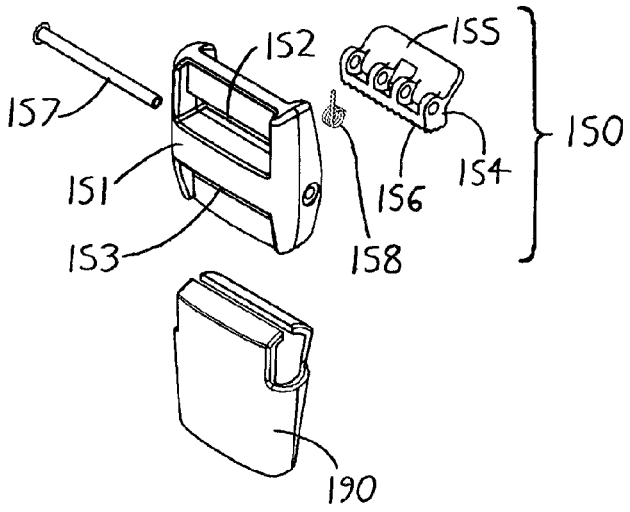
FIG. 6
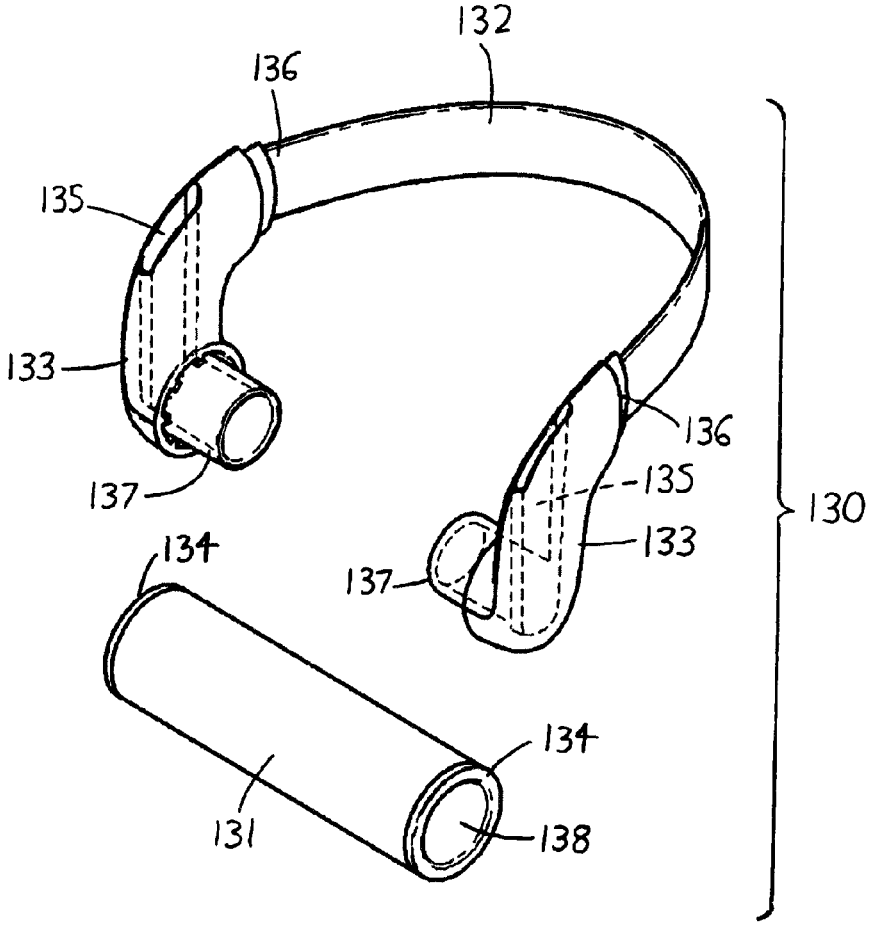

SUSPENSION TRAINING EXERCISE DEVICE

CROSS-REFERENCE TO RELATED APPLICATIONS

This application claims priority under 35 USC §119(e) to U.S. Provisional Patent Application 61/376,446 filed 24 Aug. 2010, and to U.S. Provisional Patent Application 61/429,486 filed 14 Jan. 2011. The entireties of these prior applications are incorporated by reference herein.

FIELD OF THE INVENTION

This document concerns an invention relating generally to exercise devices, and more specifically to exercise devices used for suspension training.

BACKGROUND OF THE INVENTION

Suspension training is a form of exercise and physical conditioning wherein a user works against the weight of his/her body, usually by use of grips which each dangle from a respective strap extending from a wall, ceiling, or other nearby structure. To illustrate, a user can grasp the grips and then lean forwardly or backwardly so that the grips and straps suspend (support) the user's body. The user may then push or pull on the grips to work against his/her own weight. As a more specific example, a common suspension training exercise is to grasp the grips and hold them near one's chest, and while keeping one's feet on the ground, lean forward so that one is supported by the grasped grips, and by the straps extending therefrom on the opposite sides of one's body. One may then perform push-ups against the grips, with the degree of resistance that one experiences being dependent on one's own body weight, and the degree to which one leans over (since more of one's weight is distributed to the arms as one leans further over from a fully erect position). Similarly, one can engage his/her feet in the grips (provided the grips are appropriately configured), and can place his/her hands on the ground to perform push-ups, with the height of the grips largely defining the difficulty of the push-ups.

Suspension training has been known for many years, and was initially performed using typical gymnastics rings, i.e., circular rings suspended from straps extending from an overhead bar or the like. However, typical gymnastics rings can be difficult to use for suspension training owing to difficulties in adjusting the strap length (and thus the grip height). Additionally, because typical gymnastics rings need an overhead anchor point for their straps, they typically need high ceilings for use. Thus, a variety of more easily usable suspension training devices has been developed in recent years, including those shown in U.S. Pat. Nos. 5,176,602 and 5,556,369 to Roberts; U.S. Pat. No. 5,209,712 to Ferri; U.S. Pat. No. 5,944,640 to Larsson; U.S. Pat. No. 6,652,419 to Rota; U.S. Pat. No. 6,921,354 to Shifferaw; U.S. Pat. No. 7,438,674 to Sjodin; U.S. Pat. Nos. 7,806,814, 7,785,244, 7,762,932, 7,722,508, 7,651,448, 7,090,622, and 7,044,896 to Hetrick; and U.S. D343,881 to Wilson. These references illustrate arrangements allowing mounting of suspension training devices in doorways, or to trees or other nearby structure. They additionally illustrate grips which are better adapted for suspension training exercises than conventional rings, and which are also configured to engage a user's feet as well as (or instead of) being engaged by a user's hands. There are also numerous other prior patents and published patent applications which illustrate exercise device grips which are used with (or suitable for use with) straps, e.g., U.S. Pat. No. 4,756,527 to Ledbetter, U.S. Pat. No. 5,514,057 to Ciolino, and U.S. D593,167 to Vigilia (grips suited for hands); U.S. Pat. No. 735,065 to Chellis et al., U.S. Pat. No. 3,565,424 to Macabet et al., U.S. Pat. No. 4,125,257 to Lew, U.S. Pat. No. 4,403,773 to Swann, U.S. Pat. No. 5,100,129 to Porter, U.S. Pat. No. 5,256,119 to Tudor, U.S. Pat. No. 5,558,609 to Olschansky et al., and U.S. Pat. No. 6,390,957 to Knight (grips suited for feet); and U.S. Pat. No. 3,858,874 to Weider, U.S. Pat. No. 4,685,671 to Hagerman et al., U.S. Pat. No. 5,885,190 to Reiter, and US20090054215 to McBride et al. (grips suited for both hands and feet).

Despite improvements in suspension training devices, many are still difficult and/or inconvenient to use, requiring cumbersome installation and/or removal steps, and having limited ability to be adapted for use in a wide variety of different suspension training exercises.

SUMMARY OF THE INVENTION

The invention involves suspension training devices which offers alternatives to, and improvements over, the suspension training devices discussed above. To give the reader a basic understanding of some of the advantageous features of the devices, following is a brief summary of an exemplary preferred version of the devices, with reference being made to the accompanying drawings to enhance the reader's understanding. Since this is merely a summary, it should be understood that more details regarding the exemplary version (and alternative versions) may be found in the Detailed Description provided later in this document. The claims set forth at the end of this document then define the various versions of the devices in which exclusive patent rights are secured.

Referring initially to FIG. 1, the exemplary suspension training device 10 is depicted as including a pair of training units 100 and a bridge member 20. Each training unit 100 has a flexible elongated support strap 110 which extends between a mounting button 120 and a grip 130. The bridge member 20 then includes a pair of spaced bridge apertures 22 defined therein (preferably on opposing sides of a reinforced midsection 24), with each bridge aperture 22 being sized and configured to removably receive one of the mounting buttons 120 (and its associated support strap 110) therein. As will be discussed at greater length below, each training unit 100 can be used by itself, with its mounting button 120 being used to affix its support strap 110 to a door, an overhead bar or branch, a vertical pole or trunk, the anchor 30 of FIG. 5 (discussed below), or another object so that the training unit 100 can be engaged by a user at its grip 130, and used for suspension training in the manner discussed above. The pair of training units 100 can also be used together in this manner. Alternatively, one or more of their mounting buttons 120 can be used to affix the training units 100 together at or adjacent their mounting buttons 120 such that the training units 100 extend between their grips 130; in this case, the midsection of the joined training units 100 can be wrapped about a bar, branch, pole, trunk, or the like such that a user can engage the grips 130 and engage in suspension training. As yet another alternative, the mounting buttons 120 can be slipped into the bridge apertures 22 of the bridge member 20 to engage the bridge member 20 in a manner similar to a button fitting within a buttonhole, such that the support straps 110 of the training units 100 extend from the bridge member 20. The bridge member 20 can then be fit about a bar, branch, pole, trunk, or the like to support the suspension training device 10 such that a user can engage the grips 130 and engage in suspension training. The suspension training device 10, and its training units 100, therefore allow a user a wide variety of usage options, with only a single training unit 100 being used, or with the training units 100 being used together in unjoined and spaced relationship, or being joined to each other, or being joined to the bridge member 20.

The structure of the exemplary suspension training device 10 will now be reviewed in greater detail. One of the training units 100 shown in FIG. 1 is depicted from its rear in FIG. 2, with the support strap 110 being shown in a "disassembled" configuration. The support straps 110 preferably have a strip-like configuration, with opposing support strap faces 112 spaced by a support strap thickness about the circumference of the support strap 110, and with the support strap thickness defining only a small portion of the circumference of the support strap 110 (e.g., less than a third of the circumference of the support strap 110). Stated differently, the width of the support strap 110, which is oriented perpendicular to its thickness and length, is preferably at least twice as great as its thickness. Most preferably, the support strap 110 is formed of a strip of fabric webbing. The support strap 110 of FIGS. 1-2 extends from a terminal loop 114 upon which the mounting button 120 is situated to an effective end 116 (i.e., an end of the effective length of the support strap 110 in FIG. 1), at which it extends through (and is folded about) a strap fixture 150 which is releasably engageable along the length of the support strap 110 (and from which the grip 130 descends on handle straps 170). The support strap 110 then extends from the strap fixture 150 to a strap end retainer 180 at its opposing terminal end 118. As seen in FIG. 1 (and discussed at greater length below), the strap end retainer 180 can be removably affixed along the length of the support strap 110 so that the portion of the support strap 110 extending therefrom does not dangle from the training unit 100.

The mounting button 120, shown in greater detail in FIG. 3, is a rigid member pivotally situated on the support strap 110, and is configured such that it can pivot with respect to the support strap 110 between a first (insertion) orientation (shown in FIG. 1) wherein it may be removably inserted within a bridge aperture 22 of the bridge member 20, and a second (retention) orientation (shown in FIG. 2) wherein it will resist withdrawal from the bridge aperture 22, acting similarly to a button received within a buttonhole. More specifically, when the mounting button 120 is situated in the insertion orientation with respect to the support strap 110 (as in FIG. 1), it preferably presents a first cross-sectional area (as measured along a plane perpendicular to the length of the support strap 110 extending from the mounting button 120) which is sized only slightly smaller than the area of the bridge aperture 22. When the mounting button 120 is then situated in the retention orientation with respect to the support strap 110 (as in FIG. 2), it has a second cross-sectional area (as measured along the aforementioned plane) sized substantially greater than the area of the bridge aperture 22, such that it cannot fit through the bridge aperture 22. Preferably, the second cross-sectional area is at least two times greater than the first cross-sectional area, with both cross-sectional areas being greater than the cross-sectional area of the support strap 110. While the mounting button 120 can have a variety of configurations different from that shown in the accompanying drawings, the preferred mounting button 120 shown has opposing button faces 122 spaced by a perimeter 124, with the distance between the button faces 122—which can be regarded as the thickness of the mounting button 120—defining the minor dimension of the mounting button 120, with the major dimension being situated along a perpendicular plane. (Throughout this document, the term "minor dimension" should be understood as referring to the smallest of the orthogonal length/width/height dimensions of the mounting button 120 or other item being discussed, while "major dimension" is the greatest dimension.) The mounting button 120 is continuously curved about its perimeter 124, and between the button faces 122 and the perimeter 124, whereby the mounting button 120 lacks angular corners so that it may be more easily inserted into, and removed from, a bridge aperture 22 (or other aperture, as discussed below). One of the button faces 122 has the support strap 110 protruding at least substantially centrally therefrom, with this protruding portion preferably being defined by the terminal loop 114 on the support strap 110. This loop 114 is sized such that the mounting button 120 of the other training unit 100 can be slipped therein, with the loop 114 thereafter collapsing such that the mounting button 120 is deterred from withdrawal from the loop 114. In this manner, the training units 100 can be removably affixed together without the use of the bridge member 20. As an alternative, when a training unit 100 is to be affixed to a bar, branch, pole, or other object, its mounting button 120 can orbit about the object to then be removably inserted into the terminal loop 114 upon which the mounting button 120 is situated. The support strap 110 can then be pulled to collapse the loop 114 so that the mounting button 120 cannot be pulled through the loop 114.

As noted above and seen in FIGS. 1-2, the support strap 110 extends from the mounting button 120 to a strap fixture 150 wherein the length of the support strap 110 is releasably engaged, such that the strap fixture 150 (and its associated grip 130) can be affixed at a desired region along the length of the support strap 110. The strap fixture 150 can take the form of any structure capable of engaging itself along the length of the support strap 110 until released by a user, such as a member bearing a series of apertures into which the support strap 110 is woven, a buckle structure (e.g., wherein a tongue extending from the strap fixture 150 can engage one of a series of holes formed along the support strap 110), or another structure which frictionally, mechanically, or otherwise releasably engages the support strap 110. Most preferably, the strap fixture 150 is provided in the form of a cam-buckle, a known device through which a strap is extended, and wherein a member on the cam-buckle can be urged (often by a spring) to engage the strap (often via a toothed or ridged surface), and can also be urged to release the strap (often via a lever affixed to the member). Exemplary cam-buckles can be seen, for example, in U.S. Pat. No. 6,941,620 to Hinds and U.S. Pat. No. 6,371,343 to D'Souza, and the exemplary cam-buckle 150 of FIGS. 1-2 is shown in greater detail in disassembled form in FIG. 5 (and is discussed in greater detail below). A user can therefore release the cam-buckle 150 to move it (and the associated grip 130) along the support strap 110 to a desired location with respect to the mounting button 120, and can then fix the cam-buckle 150 to the support strap 110.

A strap end retainer 180 is then preferably provided at the terminal end 118 of the support strap 110 opposite the strap fixture 150 and mounting button 120, with the strap end retainer 180 being configured to releasably join to a portion of the length of the support strap 110 (with FIG. 1 showing the strap end retainer 180 engaged to the support strap 110, and FIG. 2 showing it detached). The strap end retainer 180 thereby allows the terminal end 118 of the support strap 110 to be joined to an opposing portion of the support strap 110 so that the terminal end 118 does not dangle, which can be annoying to a user when performing suspension training. The exemplary strap end retainer 180 of FIGS. 1-2 is illustrated in greater detail in FIG. 4, and has a retainer body 182 with opposing retainer arms 184. The retainer arms 184 first extend from the retainer body 182 with a spacing therebetween at least substantially equal to the width of the support strap 110, and which thereafter extend inwardly toward each other, and adjacent a surface of the retainer body 182 in spaced relation therefrom, with a retainer strap insertion space 186 defined between the retainer arms 184. The width of a desired portion of the support strap 110 can therefore be bent/flexed, or otherwise slipped, within the retainer strap insertion space 186 to retain the support strap 110 between the retainer arms 184 and the retainer body 182 (with this space between the arms 184 and body 182 thereby defining a retainer strap mounting space 188).

Referring particularly to FIGS. 1 and 2, the exemplary grip 130, which is adjustably movable along the support strap 110 via the strap fixture 150 (e.g., the cam-buckle 150), includes an elongated rigid handle 131, an at least substantially rigid arch 132, a pair of rigid spacers 133 that space the arch 132 from the handle 131, and flexible handle straps 170 formed and configured similarly to the support straps 110, with the handle straps 170 extending from the spacers 133 and the arch 132 toward the strap fixture 150 (where the handle straps 170 are preferably affixed). The handle 131 extends between opposing handle ends 134 at opposing sides of the grip 130, and is configured to be comfortably gripped within a user's hand, i.e., it should be rounded such that it lacks perpendicular or sharper angles where gripped; should be sized such that it can be fully encircled by an average user's fingers (e.g., with a circumference of no more than approximately 12 cm); and should have height and width dimensions (i.e., the dimensions defining its circumference) which are approximately equal, or at least wherein one of these dimensions is no more than twice the other dimension. These objectives can be achieved by simply forming the handle 131 with a cylindrical outer surface sized to comfortably fit in the hand. The spacers 133 extend from each handle end 134 at an angle, preferably at an angle oriented at least substantially perpendicular with respect to the handle 131. Each spacer 133 has one of the handle straps 170 extending along at least a major portion of its length, and as seen in FIG. 6, this arrangement is preferably provided by defining spacer passages 135 within the length of each spacer 133, such that the handle straps 170 (not shown in FIG. 6) extend from the spacer passages 135 (wherein they can be fixed) to the strap fixture 150. The arch 132 then extends between opposing arch ends 136 joined to the spacers 133 at a location spaced from the handle 131, such that the arch 132 extends away from the handle straps 170 to bend between the spacers 133 along a plane spaced from the handle 131. As seen in FIGS. 1-2, the handle straps 170 are joined to the support strap 110 at the strap fixture 150 with the faces 172 of the handle strap 170 oriented in at least substantially parallel to each other, and at least substantially in abutment, as the handle straps 170 descend from the support strap 110. As each handle strap 170 descends toward the handle 131, it twists about its length such that its face 172 (its width) at least partially folds over upon itself (see particularly FIG. 1), such that the handle straps 170 are spaced with their faces 172 oriented toward each other in at least substantially parallel planes as the handle straps 170 extend from the grip 130. The foregoing arrangement causes the grips 130 to stably hang from the support straps 110 as shown in FIG. 1, such that the length of each handle 131 rests parallel to the faces (width) 112 of its associated support strap 110 (and in turn parallel to any door or wall against which the support strap 110 rests), and such that the spacers 133 extend at least substantially vertically downwardly to the handle 131, with the plane of the arch 132 oriented at least substantially horizontally. Moreover, when the two training units 100 are used together on a door or wall as situated in FIG. 1, the axes of the handles 131 are oriented at least substantially parallel. Because the grips 130 stably hang in this orientation rather than dangling in variable orientations (as in most prior suspension trainers), they are more easily engaged by a user's hands or feet during exercise. To illustrate, a user can lay prone on the ground in front of the suspension trainer 100 of FIG. 1, with his/her feet facing toward the grips 130 (which are situated at a desired elevation by use of the strap fixture 150*s*), and may then lift his/her feet to hook them into the arches 132, with no or little need to use his/her hands to reorient the grips 130 while doing so. The user may then perform push-ups or similar exercises, with the arches 132 and handles 131 of the grips 130 supporting the user's feet in a manner similar to stirrups (but wherein the stirrups are oriented more horizontally than vertically).

As noted above, the training units 100 can be suspended for use by affixing their mounting buttons 120 on one side of a door with their support straps 110 and grips 130 descending from the other side of the door (with the door supporting the training units 100 during their use), or the training units 100 may be affixed together (e.g., by use of the bridge member 20) to allow their connected ends to be draped over or around an object which supports the training units 100 during their use. Another option is to use an anchor 30 which may be affixed to nearby structure (e.g., a wall or ceiling), and which is configured to receive one or both support straps 110 of the training units 100. An exemplary anchor 30 of this nature is shown in FIG. 5, and it has an anchor rear face (not shown) which is configured for affixment to a surface (e.g., a wall, ceiling, or floor), and an anchor front face 31 configured to attach one or both support straps 110. The anchor front face 31 has anchor tongues 32 with lengths extending in opposing directions from opposing sides of the anchor front face 31 to terminate in free ends 33. The lengths of the anchor tongues 32 are closely spaced adjacent each other to define an anchor strap insertion slot 34 therebetween (which preferably extends diagonally), and are also closely spaced adjacent the anchor front face 31 to define an anchor strap mounting passage 35 between the anchor tongues 32 and the anchor front face 31. A portion of the length of a support strap 110 can be inserted within the anchor strap insertion slot 34 to rest within the anchor strap mounting passage 35, and the support strap 110 can then (if desired) be pulled until its mounting button 120 abuts the anchor 30. The support strap 110 is then supported by the anchor 30 for use by a user, and can be removed from the anchor 30 when desired.

Further advantages, features, and objects of the invention will be apparent from the remainder of this document in conjunction with the associated drawings.

BRIEF DESCRIPTION OF THE DRAWINGS

FIG. 6 is a detailed perspective view of the disassembled grip 130 and strap fixture 150 of FIGS. 1-2 (as well as a handle strap skirt 190 associated with the strap fixture 150), shown without the handle straps 170 seen in FIGS. 1-2.

DETAILED DESCRIPTION OF PREFERRED VERSIONS OF THE INVENTION

Figure 1:
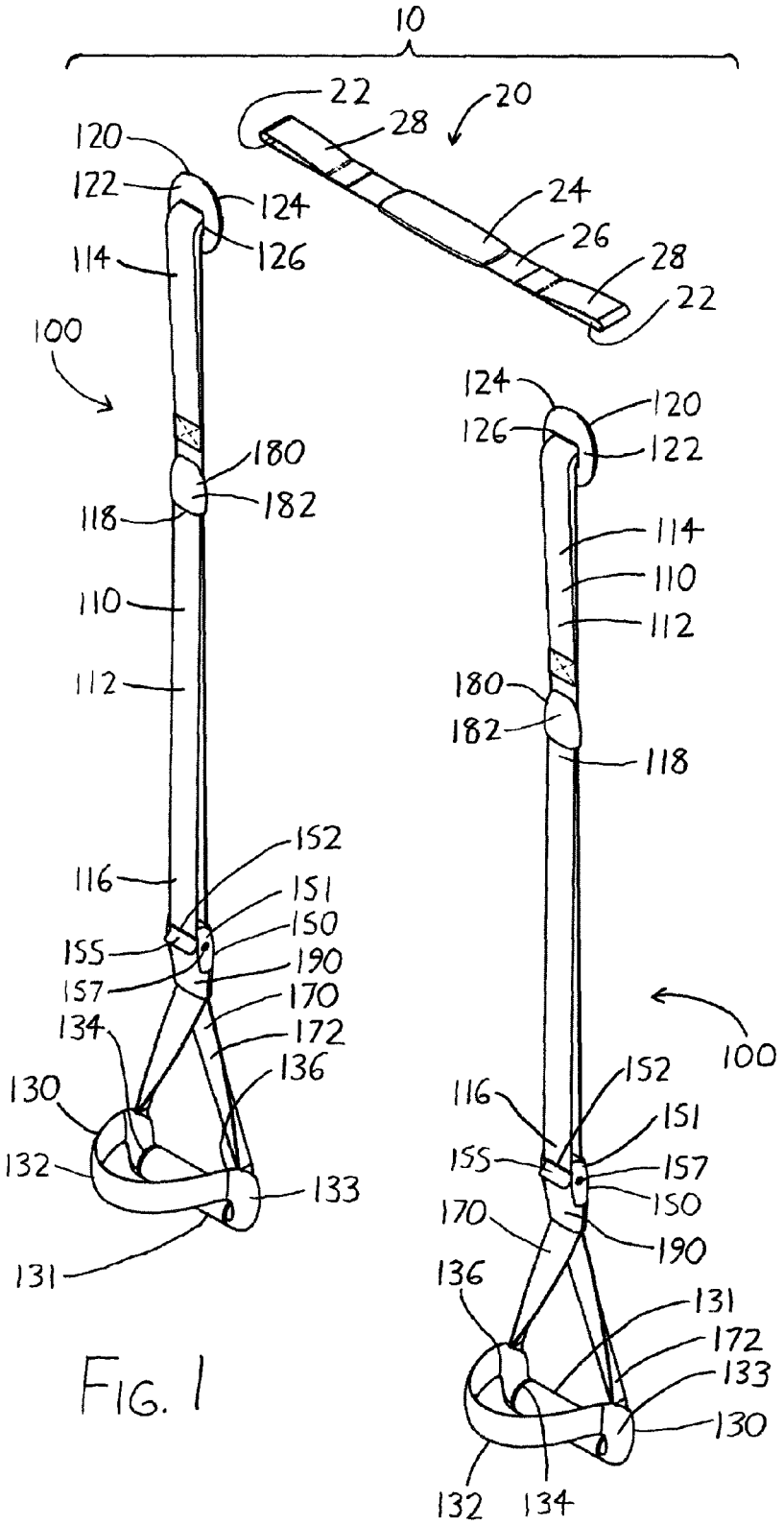
FIG. 1 is a perspective view of the front of an exemplary (disassembled) suspension training device 10, illustrating a pair of training units 100, each having a grip 130 descending from a mounting button 120 on a support strap 110, and a bridge member 20 having a pair of bridge apertures 22 into which the mounting buttons 120 can be affixed to assemble a version of the suspension training device 10 wherein the bridge member 20 can be wrapped over or about an object (e.g., a pole) with the support straps 110 extending therefrom to present the grips 130 for use by a user.

Before discussing the exemplary and other versions of the suspension training device 10 in greater detail, it is initially useful to review the intended meanings of some of the terminology used throughout this document.

Throughout this document, the term "strap" (or "straps") will commonly be used to describe the elongated member(s) which extend from or between the grips 130. While the straps preferably have the structure commonly implied by the term "strap"—i.e., an elongated length of material having a width sized substantially greater than its thickness—such a structure is not necessary in all versions of the suspension trainer. Thus, the term "strap" should be understood to also encompass rope, cord, tubing, chain, or other flexible elongated members having similar performance, unless the features of the version of the suspension trainer being discussed mandate the use of strap in the form of an elongated length of material having a width sized substantially greater than its thickness.

Where "straps" are mentioned, this can (unless indicated otherwise by context) refer to either separate straps (which may be joined together), or separate lengths of the same strap. As an example, this document occasionally refers to the grip 130 having "handle straps" 170 extending from its opposing sides (as in FIGS. 1-2). In this context, the handle straps 170 can (for example) be separate straps having terminal ends joined at or adjacent the strap fixture 150 and opposing terminal ends affixed to the spacers 133, or could instead be a single strap having its length extend through the handle 131 and spacers 133 with its opposing terminal ends joined at or adjacent the strap fixture 150 (or alternatively having its length folded over within the strap fixture 150 and having its opposing terminal ends affixed to the spacers 133 and/or within the handle 131). Other arrangements for the handle strap(s) 170 are possible as well.

Additionally, when this document refers to an "end" of a strap, it should be understood, depending on the context of the discussion, that the end being referred to may not be a terminal end of the entire length of the strap, and may instead be an effective end defined at a fold along the length of the strap. To illustrate, in FIG. 1, the grips 130 can be said to be situated at the ends of the support straps 110, though the support straps 110 extend through the strap fixtures 150 to have their terminal ends rest at the strap end retainers 180. Stated differently, where a strap is folded over to double back on itself (as where the support strap 110 folds through the strap fixture 150 at its effective end 116), the location of the fold can be regarded as defining a "strap end," though it does not have a terminal/free strap end.

When referring to "handle ends" 134, "arch ends" 136, and the like, it should be understood that while the "ends" may delimit portions of the structures being referred to, the structures need not necessarily terminate at the ends. To illustrate, the arch 132 of FIG. 6 is integrally joined to the spacers 133 at its arch ends 136, but the arch ends 136 do not define the terminal ends of the joined arch 132 and spacers 133. Similarly, the handle 131 of FIG. 6 could be integrally joined to the spacers 133 at its handle ends 134 whereby the handle ends 134 still define the ends of the handle 131, but in this case the handle ends 134 would not define the terminal ends of the joined handle 131 and spacers 133.

Most terms used in this document to describe characteristics of items should be understood as describing such items during their conventional usage. For example, where the term "rigid" is used to describe an item in this document—e.g., rigid handle 131, rigid spacers 133, etc.—it should be understood to mean that the item does not undergo substantial flexure/bending when the item is used by an average user for its intended purpose.

The exemplary suspension training device 10 will now be reviewed in greater detail. As noted in the foregoing Summary, a user can use a single training unit 100 by itself for suspension training, or can use the training units 100 together. The suspension training patents noted near the outset of this document illustrate a number of suspension training exercises that can be performed with use of one or both of the training units 100, and additional exercises are possible as well (in particular, exercises wherein one stands on the handles 131 of the grips 130, as the grips 130 are well-adapted for this purpose). When two training units 100 are used, they may remain separate and spaced during use, or they may instead be joined by the bridge member 20, or by the insertion of one or both mounting buttons 120 into the terminal loop(s) 114 of the opposing training unit(s) 100. When one or both training units 100 are used in an unjoined state, a training unit 100 can be mounted in a doorway by shutting its terminal loop 114 in a door with its mounting button 120 resting on one side of the door, and with its grips 130 and the major length of its support strap 110 extending from the other side of the door for use. Alternatively, a training unit 100 can be affixed about a pole, branch, or similar object by orbiting the mounting button 120 about the object and then inserting the mounting button 120 within the terminal loop 114 upon which it is situated, or by simply orbiting the support strap 110 about the object and extending its grip 130 through its terminal loop 114, and thereafter pulling the support strap 110 to close the "noose" formed about the object. As another option, where a hook or similar protrusion is available in a user's environment, the user could simply install the terminal loop(s) 114 of the training unit(s) 100 on the protrusion. As yet another option, the anchor 30 of FIG. 5, which is discussed at greater length below, can be affixed to a wall, ceiling, floor, or other structure to have the support strap(s) 110 of one or more training units 100 affixed therein. When the training units 100 are used in the joined state, they can be wrapped about a pole, branch, or similar object near the location at which they are joined (either via the bridge member 20 or via the mounting buttons 120 and terminal loops 114), with the grips 130 and major lengths of the support straps 110 extending from opposing sides of the object for use. Alternatively, the joined portions of the training units 100 can be situated on one side of a closed door, and the grips 130 and major lengths of the support straps 110 may extend from the opposite side of the closed door for use (with the support straps 110 both extending from the same edge of the door, e.g., from the top edge, or from different edges, e.g., the right and left edges). It is notable that the bridge member 20 need not be used to join the training units 100, though the bridge member 20 is useful when the joined training units 100 are to be wrapped about an object that might cause undue wear on the support straps 110 (such as a rough tree branch), since its reinforced midsection 24 is resistant to such wear. The suspension training device 10 therefore offers significant flexibility, as it may be mounted for use in a wide variety of different locations, in a wide variety of different configurations, with no or little need for additional mounting hardware.

The construction of the exemplary training units 100 will now be discussed in greater detail starting with the mounting buttons 120 of FIGS. 1-3. As noted above, each mounting button 120 is intended to be used in a manner like an oversized button, wherein the mounting button 120 is fit within a suitable aperture to be retained therein (by virtue of the shapes of the mounting button 120 and aperture) until removed in a manner similar to the removal of a button from a buttonhole. The mounting buttons 120 are also intended to be used as oversized stops which prevent the support straps 110 from being pulled through an aperture or space, e.g., from between a closed door and the frame into which the door is fit, or from the anchor strap mounting passage 35 of the anchor 30 of FIG. 5. For easy insertion within and removal from an aperture (such as the aperture of the terminal loop 114 of the support strap 110, or a bridge aperture 22 of the bridge member 20), each mounting button 120 preferably has a smooth and continuously curved outer surface which lacks sharp corners, with the pillow-like shape of FIG. 3 being particularly preferred. Each mounting button 120 is also preferably weighted (if not already made of a heavy material) and configured such that when thrown over the top of a door, a horizontal bar, a tree branch, or similar object, the mounting button 120 will help maintain the support strap 110 draped over the object, and resist slipping and falling backwardly from the object. The ability of the mounting button 120 to "stay" the support strap 110 atop an object depends largely on the weight of the mounting button 120, the friction arising between the support strap 110 and the object, and any interference encountered between the mounting button 120 and the object. It has been found that for a preferred training unit 100 configured as in FIGS. 1-2, using nylon webbing for the support strap 110 (such webbing having relatively low friction), the mounting button 120 will usually adequately serve to stay the support strap 110 atop an object if it has a weight at least 80% of that of the support strap 110. (In this preferred training unit, the overall training unit 100 weighs approximately 0.48 kg; the support strap 110—including the strap end retainer 180—weighs approximately 0.1 kg; the grip 130 weighs approximately 0.29 kg, including the handle strap 170 and cam-buckle 150 or other strap fixture 150; and the mounting button 120 weighs approximately 0.09 kg.)

However, it should be understood that the mounting button 120 could assume a wide variety of different configurations and weights, so long as the mounting button 120 serves one or more of the button function, the stop function, and/or the stay function noted above. To illustrate, the mounting button 120 might simply assume the form of a short length of tubing situated on the terminal loop 114 (with the strap of the loop 114 situated within the interior of the tube), whereby the tube can be axially inserted into a terminal loop 114, bridge aperture 22, or other aperture wherein the mounting button 120 is to be affixed, and the tubular mounting button may then be pivoted such that its length interferes with withdrawal from the aperture. Regardless of its form, the mounting button 120 is preferably formed of soft plastic or other material, whereby it has limited likelihood of scratching or denting a door or other object against which it is situated. The mounting button 120 can be coated or overmolded with an elastomer or other soft material for this purpose.

Figure 3:
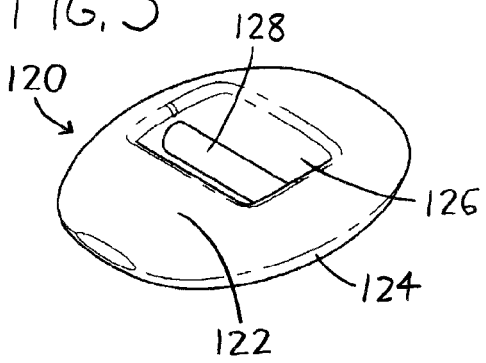
FIG. 3 is a detailed perspective view of the mounting button 120 of FIGS. 1-2, shown without the support strap 110 of FIGS. 1-2.

In the preferred mounting button 120 of FIG. 3, the plastic or other material of the mounting button 120 is formed to define a button pocket 126 therein, with a (preferably metal) rod 128 or other member extending laterally across the pocket and being spaced from the walls of the pocket (except from the lateral walls of the pocket wherein the member 128 extends). When forming the terminal loop 114, the support strap 110 is inserted through the pocket to extend beneath the member 128, and its terminal end is then folded back on the support strap 110, and sewn or otherwise affixed thereon, to form the terminal loop 114. During this process, the terminal loop 114 is preferably sized several times larger than the smallest cross-sectional area of the mounting button 120, such that when the terminal loop 114 is wrapped about a pole, branch, or similar object, there is a sufficient length of the terminal loop 114 extending therefrom that the mounting button 120 can still be slipped into the terminal loop 114.

After insertion of the mounting button 120 within the terminal loop 114, the terminal loop 114 will then collapse owing to the flexible nature of the support strap 110 (particularly when the support strap 110 is pulled taut), with the end of the terminal loop 114 adjacent the mounting button 120 being retained within the terminal loop 114 by the mounting button 120. The training unit 100 is thereby mounted for use by a user in the performance of suspension training exercises. Most preferably, the terminal loop 114 is sized such that a grip 130 can fit closely through, whereby a user can mount a training unit 100 to an object by extending the support strap 110 about the object until the grip 130 approaches the mounting button 120 and its terminal loop 114. The grip 130 may then be inserted into the terminal loop 114 to form a noose about the object, and may be pulled to tighten the noose, so that the grip 130 and a major length of the support strap 110 extends from the object. (Note that this mounting arrangement is one which does not require the use of the mounting button 120.) As an alternative to a fixed-size terminal loop 114, the terminal end of the support strap 110 could be affixed to an adjacent length of the support strap 110 by a cam-buckle 150 or other strap fixture 150, whereby the terminal loop 114 can have adjustable size (and might be openable and closable by the user). With such an arrangement, a user might simply form a terminal loop 114 about an object, and/or reduce the terminal loop 114 in size after insertion of a mounting button 120 through the terminal loop 114, such that the object or mounting button 120 cannot be released until the use opens or resizes the terminal loop 114.

The support strap 110 then extends from the terminal loop 114 and the mounting button 120 to the strap fixture 150, which is configured to engage the grip 130 to the support strap 110, but to also be releasable and movable along the support strap 110 to re-engage the support strap 110 at a desired location along its length. As noted above, the preferred strap fixture 150 shown in FIGS. 1-2 and 6 is a cam-buckle (best seen in FIG. 6 in disassembled form). The cam-buckle 150 has a buckle body 151 with a top cam-buckle aperture 152 through which the support strap 110 is fit, a bottom cam-buckle aperture 153 through which the handle strap 170 is fit (as discussed below), and a cam 154 having a lever 155 and an opposing toothed/knurled face 156, wherein the cam 154 is rotatably affixed to the buckle body 151 via a pin 157, and is biased by a spring 158 such that the toothed/knurled face 156 is urged to close the top cam-buckle aperture 152 (and thereby engage the support strap 110 extending therein). By pressing the lever 155 to defeat the spring 158, thereby releasing the toothed/knurled face 156 from the support strap 110, the support strap 110 is released to slide through the top cam-buckle aperture 152, thereby allowing relocation of the cam-buckle 150 to a desired location along the support strap 110. Release of the lever 155 will cause the toothed/knurled face 156 to again engage the support strap 110, locking the support strap 110 in place within the top cam-buckle aperture 152.

The strap fixture 150 need not be provided in the form of a cam-buckle 150, nor must it be adjustably movable along the support strap 110, and it could instead be immovably joined to the grip 130, e.g., it could simply take the form of a sewn connection between the support strap 110 and the handle straps 170. As another alternative, the strap fixture 150 might movably (or immovably) join the support strap 110 to one or more other straps or other structures which are in turn connected to the grip 130, e.g., an elongated grip strap could extend from the bottom cam-buckle aperture 153, and could in turn be connected to the grip 130 (e.g., at its handle straps 170). Regardless of the form of the strap fixture 150, if it is formed of rigid material, the material is preferably chosen (and the strap fixture 150 is preferably configured) to minimize damage to any surfaces that the strap fixture 150 might impact during use of the suspension training device 10. For example, the cam-buckle 150 shown in FIGS. 1-2 and 6 is preferably given a cover or surface coating of an elastomeric material, and is preferably designed to lack any protruding sharp corners.

The strap fixture 150 is also preferably configured such that it presents a relatively flat surface from its inner side (seen in FIG. 2), one which is free of sharp protrusions, since a user's arm or leg may contact or rub against the inner side of the strap fixture 150 during suspension training exercises. A handle strap skirt 190 (best seen in FIG. 6) is provided at the bottom of the cam-buckle 150 in part for this reason, and it is formed such that it can fit over the bottom of the cam-buckle 150, and snap into the bottom cam-buckle aperture 153 over the handle strap 170. The handle strap skirt 190 therefore helps to present the cam-buckle 150 (and the handle strap 170 descending therefrom) with a smoother and less discontinuous inner surface, thereby causing less chafing on a user's arm or leg. The handle strap skirt 190 is preferably formed of an elastomeric or rigid plastic which minimizes discomfort when the skirt rubs against the user, and which also allows the skirt to be removably fit over the bottom of the cam-buckle 150.

Figure 4:
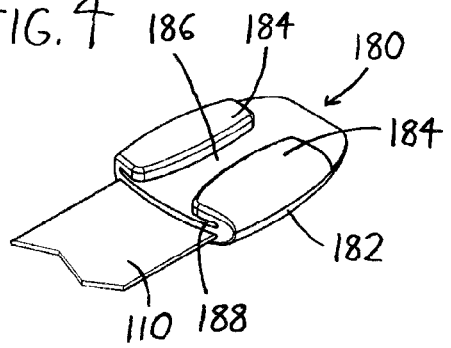
FIG. 4 is a detailed perspective view of the strap end retainer 180 of FIGS. 1-2, shown from its inside surface (with its outside surface being depicted in FIGS. 1-2).

From the strap fixture 150, the support strap 110 extends to the strap end retainer 180 shown in detail in FIG. 4. The strap end retainer 180 serves to allow removable attachment of the terminal end 118 of the support strap 110 to a desired location along the length of the support strap 110 between the mounting button 120 and the strap fixture 150, so that the terminal end 118 of the support strap 110 does not dangle while suspension training exercises are being performed (which can be annoying to a user).

The strap end retainer 180 also preferably serves to weight the terminal end 118 of the support strap 110 so that if the terminal end 118 is instead left to dangle, the strap end retainer 180 tends to pull the terminal end 118 substantially straight downwardly and minimize its swinging and/or flapping while suspension training exercises are being performed (which, again, can be annoying to a user). The strap end retainer 180 is preferably molded about the terminal end 118 of the support strap 110, or otherwise surrounds at least a substantial portion of the circumference of the support strap 110 at its terminal end 118, whereby it deters fraying of the terminal end 118. The strap end retainer 180 is preferably formed of resiliently flexible material, i.e., a material which can flex (at least to a small degree), and which then returns to its original shape. Most preferably, the strap end retainer 180 is formed of a high-density elastomer whereby its retainer arm(s) 184 can at least partially flex to more easily receive the support strap 110, and is also formed with sufficiently low hardness that it is unlikely to damage any surfaces against which it might swing. For this purpose, the strap end retainer 180 is also preferably streamlined/curved such that it lacks any sharp corners which might damage any surfaces against which the strap end retainer 180 might swing. It is noted that while the strap end retainer 180 is a preferred feature of the suspension training device 10, it is optional, and need not be included. If included, it need not take the form shown in FIG. 4, and could assume any form that serves the aforementioned terminal end attachment and/or terminal end weighting functions. It is notable that any strap end retainer 180 preferably serves both functions, since some users may have a strong preference for attached support strap terminal ends 118 (to avoid annoying dangling ends 118), whereas others may have a strong preference for detached support strap terminal ends 118 (since these can allow easier adjustment of the effective length of the support strap 110 without the need to attach/detach the support strap terminal end 118 with respect to the remainder of the support strap 110).

Figure 2:
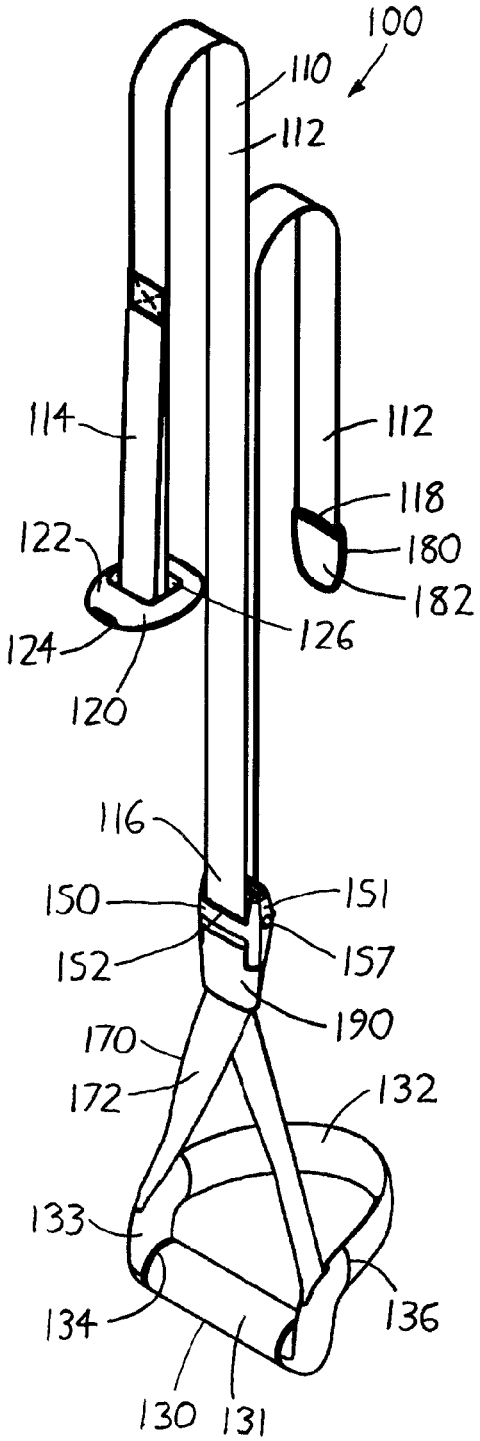
FIG. 2 is a perspective view of the rear of a training unit 100 of FIG. 1, showing the support strap 110 extending from the mounting button 120, through a strap fixture 150 which affixes the grip 130 at a desired portion along the length of the support strap 110, and to a strap end retainer 180 which can be fixed along the length of the support strap 110 to prevent the terminal end 118 of the support strap 110 at the strap end retainer 180 from dangling when the training unit 100 is in use.

As best seen in FIGS. 1-2, the handle straps 170 then extend between the grip 130 and the strap fixture 150. The handle straps 170 are preferably configured similarly or identical to the support straps 110, and therefore preferably have opposing handle strap faces 172 spaced by a handle strap thickness about the circumference of the handle strap 170, wherein the handle strap thickness defines less than a third of the circumference of the handle strap 170 (or, stated differently, the widths of the handle strap faces 172 are preferably at least twice as great as the handle strap thickness). Most preferably, referring to FIG. 6, the handle straps 170 are formed as a single strap which has its length extend through the interior of the handle 131 and from the opposing handle ends 134, then through the spacer passages 135, and then having its terminal ends being sewn adjacent to or within the bottom cam-buckle aperture 153. The sides of the handle strap 170 on the opposing sides of the cam-buckle 150 are then sewn together below the cam-buckle 150 so that a handle strap loop (not shown) is defined at the tops of the handle straps 170, wherein the cam-buckle 150 is affixed within the handle strap loop. This handle strap loop is not visible in FIGS. 1-2 owing to the presence of the handle strap skirt 190 (FIG. 6), which fits over the handle strap 170 loop and the lower portion of the cam-buckle 150 to present a smooth surface to a user (as discussed above), and which also helps to better align the handle straps 170 descending from the cam-buckle 150 into a parallel relationship adjacent to each other. From this parallel relationship, the handle straps 170 descend, spread, and twist to enter the spacers 133 of the grip 130 at or adjacent the ends of the arch 132, with their faces 172 in orientations perpendicular to their orientations at the strap fixture 150 and handle strap skirt 190 (and perpendicular to the faces 112 of the support strap 110). As a result, when the grip 130 hangs from the support strap 110 in a manner shown in FIG. 1, the grip 130 tends to stably rest in the orientation shown in FIG. 1. As with other features of the preferred suspension training device 10 shown in the drawings, the handle straps 170 are optional, and could be replaced by (for example) rigid members extending from the spacers 133 or adjacent structure on the grips 130, or could simply be omitted so that the support strap 110 is joined directly to the handle 131 or adjacent structure of the grips 130.

Looking to the exemplary grips 130 as shown in FIGS. 1 and 2, and particularly looking to FIG. 6, the handle 131 of each training unit 100, and preferably its arch 132 as well, is configured to be comfortably received and grasped by a user's hand. To enhance the user's engagement with the grip 130, the handle 131 and arch 132 may be provided with a higher-friction and/or resiliently compressible outer surface, as by situating an elastomeric sleeve about the handle 131 and grip 130. (In this respect, the midsection of the arch 132 is actually shown incomplete in FIG. 6: it preferably bears an overmolded elastomeric sheath which defines an outer arch surface adjacent to the outer surface of the adjacent spacers 133, such that continuous surfaces are defined where the arch 132 and spacers 133 merge.) The spacers 133 (into which the handle straps 170 extend) and the arch 132 are preferably integrally formed as a single unit, with the spacers 133 bearing opposing inwardly-extending plugs 137 which fit into an interior handle passage 138 formed in the handle 131. The spacer passages 135 descend within the spacers 133 to open centrally on the plugs 137, whereby the handle strap 170 can extend through one spacer passage 135, then through the interior handle passage 138, and then out the other spacer passage 135 to have its opposing ends joined at the strap fixture 150. As a result, when a user engages the handle 131, he/she is supported by the handle strap 170 within the handle 131. The spacers 133 preferably space the handle 131 from the arch 132, and from the locations where the handle straps 170 exit the spacers 133, by such a distance that the weight of the handle 131 generates a moment force sufficient to orient the plane of the arch 132 at least substantially horizontally when the grips 130 dangle (as shown in FIG. 1). This generally horizontal orientation of the arch 132 is useful when a user wishes to hook a foot between the arch 132 and the handle 131 without the need to use his/her hands to orient the grip 130 to readily receive the foot. At the same time, the spacers 133 situate the handle 131 beneath the arch 132 so that the arch 132 does not readily obstruct a user's grasping of the handle 131, or the user's standing thereon.

As with other components of the suspension training device 10, the grips 130 need not necessarily assume the forms shown in the accompanying drawings, and numerous variations are possible. As examples, the spacers 133 need not bear the plugs 137 or otherwise positively restrain the handle 131 with respect to the spacers 133, and the spacers 133 could simply have inner sides or bottom surfaces at which the spacer passages 135 open to pass the handle strap 170 to the handle 131; the spacers 133 could be omitted so that the handle 131 rests directly within the arch 132 (in which case members similar to the spacers 133 might extend upwardly from the handle ends 134/arch ends 136 to receive the handle straps 170, so that the aforementioned generally horizontal resting orientation of the arch 132 is more easily achieved); the arch 132 could be formed in shapes other than a continuously-curving "C" shape, e.g., in the form of straight segments joined to each other at angles (and possibly including a segment configured similarly to the handle 131, for easier gripping by a hand); the arch 132 might be formed of a flexible strap (though an at least substantially rigid arch, one which avoids drooping/collapsing, is preferred); and/or the handle straps 170 might join to the grip 130 by alternative arrangements, such as rings at the ends of the spacers 133 and at the arch ends 136, to which the handle straps 170 may be sewn or otherwise attached. It is emphasized that these variations are exemplary, and numerous other variations are possible. In a preferred variant, the spacers 133 lack the plugs 137, and the spacers 133 extend downwardly to terminate in ends onto which the spacer passages 135 open. The handle strap 170 then extends through the handle 131 and into the spacer passages 135 at these indented spacer ends (which are not joined to the handle, such that they can rest adjacent the handle ends 134). This variant reduces the materials used in, and the weight of, the grip 130, with no significant difference in performance from the version shown in the drawings.

The exemplary bridge member 20 depicted in FIG. 1 is formed of a bridge member strap 26 (made of webbing or the like) terminating in flexible bridge member loops 28 at its opposing ends, with the loops defining the aforementioned bridge apertures 22. As with the terminal loops 114 of the support straps 110, these bridge member loops 28 may receive the mounting buttons 120 within the bridge apertures 22, with the flexible bridge member loops 28 thereafter collapsing (particularly under tension) such that the support straps 110 and their mounting buttons 120 remain within the bridge member loops 28 until removed by a user. The reinforced midsection 24 may be formed of a durable (but preferably flexible) plastic which is molded over the bridge member strap 26, or through which the bridge member 20 is (preferably tightly) slipped. The midsection 24 may bear a higher-friction and/or resiliently compressible outer surface so that it better resists slippage when draped atop or about an object, e.g., a tree branch, pole, or similar object; as an example, it could simply be formed with ridges or the like oriented perpendicularly to the axis extending between the bridge apertures 22. As previously noted, the bridge member 20 can be draped over or wrapped about an object, and the mounting buttons 120 of the training units 100 can each be slipped into a respective bridge member 20 loop so that the training units 100 (and the bridge loops) extend from opposing sides of the object about which the bridge member 20 is curved. As an alternative, the bridge member 20 can be draped/wrapped about the object to bring its bridge member loops 28 into adjacent relationship, and one or both training units 100 may then have their mounting buttons 120 inserted into both of the bridge member loops 28 to affix the training unit(s) 100 to the bridge member 20 and object. In either of the foregoing cases, the terminal loops 114 of the support straps 110 (and their mounting buttons 120) may be more firmly engaged to the bridge member loops 28 by curving the terminal loops 114 about the outsides of the bridge member loops 28 into which they are inserted, and inserting their mounting buttons 120 into their adjacent terminal loops 114. It is notable that the bridge member 20 is an optional component of the suspension training device 10, though it is preferred when the training units 100 are to be extended and joined about an object that might cause wear to the support straps 110 of the training units 100.

Figure 5:
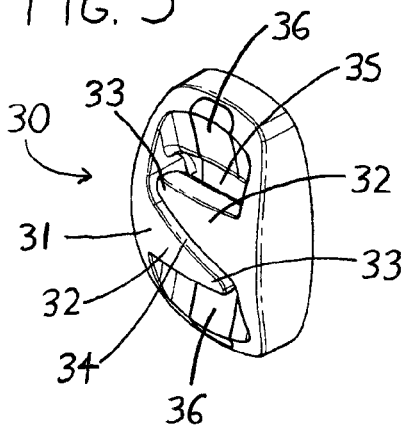
FIG. 5 is a perspective view of the front of an exemplary anchor 30 suitable for mounting to a wall, ceiling, floor, or other structure, and into which the support strap 110 of a training unit 100 may be inserted, preferably adjacent its mounting button 120, to ready the training unit 100 for use.

The exemplary anchor 30 of FIG. 5 preferably has a rear surface (not shown) which is at least substantially planar so that it may closely rest against a wall, ceiling, floor, or other flat area, and fastener apertures (not shown) are provided from the front surface 31 to the rear surface so that fasteners such as screws can extend through the anchor 30 and into the area. The unshown fastener apertures are preferably situated behind fastener cover plugs 36, which may be removed from the anchor 30 to expose the fastener apertures and inserted into the anchor 30 to cover the fastener heads. The anchor strap mounting passage 35 effectively defines a tunnel within the anchor 30 with spaced entry and exit points for the support strap 110, wherein the ceiling of the tunnel bears a (preferably diagonal) anchor strap insertion slot 34 to allow easier insertion of the support strap 110 within the anchor strap mounting passage 35. The anchor strap insertion slot 34 divides the ceiling of the anchor strap mounting passage 35 into the opposing anchor tongues 32. Insertion of the support strap 110 within the anchor strap insertion slot 34, and in turn into the anchor strap mounting passage 35, is most easily effected by inserting the support strap 110 within the insertion slot 34 so that it rests over a first one of the anchor tongues 32 and under the second; then grasping portions of the support strap 110 on opposing sides of the first anchor 30 tongue, and rotating the support strap 110 so that it is roughly parallel to the insertion slot 34; and then pushing/working the support strap 110 beneath the second anchor 30 tongue so that the support strap 110 extends beneath both tongues 32, and within the anchor strap mounting passage 35. The support strap 110 can then be pulled through the anchor strap mounting passage 35 until its mounting button 120 abuts the anchor 30, such that the training unit 100 is supported by the anchor 30 and ready for use. Alternatively, a portion of the support strap 110 within the terminal loop 114 may be inserted within the anchor strap mounting passage 35 such that the anchor tongues 32 rest within the terminal loop 114. While the anchor strap mounting passage 35 need not be diagonally oriented—for instance, it could simply be situated at one side of the anchor strap mounting passage 35, such that only a single anchor tongue extends from one side of the anchor 30 toward the other—the diagonal slot 34 (and opposing tongues 32) are useful to deter the support strap 110 from slipping out of the slot 34.

As with the bridge member 20, the anchor 30 is an optional component of the suspension training device 10, but is preferably provided to allow users additional options for mounting training units 100 for use, particularly at locations where bars, poles, or other suitable mounting objects may be lacking, and where door mounting may be inconvenient or otherwise undesirable. The anchor 30 beneficially allows speedy and easy insertion and removal of the support strap 110 from its front face 31: it takes mere seconds to sturdily install or remove the support strap 110. In contrast, where one wishes to positively engage a training unit 100 to an object by wrapping its terminal loop 114 about the object so that the loop 114 rests on the opposite side of the object from the remainder of the support strap 110, and then inserting the grip 130 and the remainder of the support strap 110 through the terminal loop 114 to form a noose about the object, this method can take perhaps half a minute to perform, and it can take even longer to disengage the noose of the training unit 100 from the object. While such a delay is not terribly significant, it can be annoying where a user is performing a timed exercise regimen wherein one or more training units 100 are to be rapidly moved from location to location to perform different suspension training exercises. A user can therefore install anchors 30 at different desired locations, and can very rapidly install the training unit(s) 100 in, and remove them from, these locations.

Exemplary versions of the invention are described above, with a particularly preferred version being shown in the accompanying drawings, and it is emphasized that the invention is not limited to these versions, and it extends to all different versions that fall literally or equivalently within the scope of the claims set forth at the end of this document. Thus, features and functions of the exemplary versions may be omitted, and might be replaced with other features and functions, such as features and functions noted in the patents and patent applications noted earlier in this document. To illustrate, the support straps 110 might be replaced with support straps shown in these prior references (or with other support straps), as by situating the grips 130 of the suspension training device 10 on opposing ends of a single support strap rather than on ends of separate support straps 110; the mounting arrangements (i.e., the mounting buttons 120 and/or the anchor 30) might be replaced with mounting arrangements shown in these prior references (or with other mounting arrangements), as by simply providing a knot or other obstruction on the support strap 110 in place of the mounting button 120, or by providing a hook, carabiner, ring, screw, or other attachment structure in place of the mounting button 120; and/or the grips 130 might be replaced with grips shown in these prior references (or with other grips), such as simple webbing loops (with or without rigid handles thereon), cuffs or harnesses that tightly engage about wrists, feet, or ankles, etc. If such alternative suspension training devices are nonetheless defined by the claims below, or are otherwise legally equivalent to suspension training devices defined by these claims, they too are encompassed by this patent.

What is claimed is:

1. A suspension training device including:

a. an elongated support strap, b. a grip situated at an end of the support strap, c. a mounting button situated on the support strap at a second end of the support strap, opposite the end at which the grip is situated, d. a loop situated along the support strap, the loop:

(1) being sized to allow insertion of the mounting button, and a portion of the support strap adjacent the mounting button, through the loop, (2) collapsing unless urged open by a user, whereby the inserted mounting button cannot be withdrawn from the loop unless the loop is urged open by the user, wherein the mounting button is a rigid mounting button and is sized greater than the diameter of the support strap.

2. The suspension training device of claim 1, wherein the mounting button:

a. includes opposing button faces spaced by a perimeter, wherein:

(1) the distance between the button faces defines a minor dimension of the mounting button, and (2) the mounting button is continuously curved:

(a) between the button faces and the perimeter, and (b) about the perimeter; and b. one of the button faces has the support strap protruding at least substantially centrally therefrom.

3. The suspension training device of claim 2 wherein:

a. the second end of the support strap terminates in the loop opposite the end at which the grip is situated;

b. the loop extends into the button face from which the support strap protrudes.

4. The suspension training device of claim 2:

a. wherein the support strap has a terminal end opposite the mounting button, b. further including a strap end retainer on the terminal end, the strap end retainer having a retainer arm protruding therefrom to extend adjacent a surface of the strap end retainer in spaced relation therefrom, with the space between the retainer arm and the surface of the strap end retainer defining a retainer strap insertion space, whereby a portion of the length of the support strap can be inserted within the retainer strap insertion space to retain the portion between the retainer arm and the surface of the strap end retainer.

5. The suspension training device of claim 4 wherein the grip is adjustably affixed along the length of the support strap between the mounting button and the strap end retainer.

6. The suspension training device of claim 2 wherein the grip includes:

a. flexible handle straps extending from opposing sides of the grip toward the support strap;

b. an elongated rigid handle extending between the opposing sides of the grip;

c. an at least substantially rigid arch extending between opposing arch ends, each arch end:

(1) extending from one of the handle straps, and (2) being spaced from the handle.

7. The suspension training device of claim 1 wherein the loop is further:

a. sized to allow insertion of the grip, and a portion of the support strap adjacent the grip, through the loop, b. structured to collapse unless urged open by a user, whereby the inserted grip cannot be withdrawn from the loop unless the loop is urged open by the user.

8. The suspension training device of claim 1, wherein the mounting button is a rigid mounting button:

a. pivotally situated on the support strap, and b. configured such that it can pivot with respect to the support strap between:

(1) a first orientation wherein the mounting button has a first cross-sectional area measured along a plane perpendicular to the length of the support strap extending from the mounting button, and (2) a second orientation wherein the mounting button has a second cross-sectional area measured along a plane perpendicular to the length of the support strap extending from the mounting button, the second cross-sectional area being at least two times greater than the first cross-sectional area.

9. The suspension training device of claim 8 further including a bridge member including a pair of spaced bridge apertures defined therein, each bridge aperture being configured to:

a. removably receive the mounting button therein when the mounting button is inserted into the bridge aperture in the first orientation, and b. resist withdrawal of the mounting button therefrom when the mounting button is in the second orientation.

10. The suspension training device of claim 1 in combination with:

a. a second support strap and grip as defined in claim 1, and b. a bridge member including a pair of spaced bridge apertures defined therein, each bridge aperture being configured to removably receive one of the support straps therein.

11. The suspension training device of claim 10 wherein the bridge member is flexible about at least a portion of the circumferences of the bridge apertures, whereby the bridge apertures may be flexed open and/or collapsed shut.

12. The suspension training device of claim 1 wherein the support strap has:

a. a thickness oriented perpendicular to the length of the support strap;

b. a width oriented perpendicular to the length and thickness of the support strap, wherein the width is at least twice as great as the thickness;

c. a terminal end;

d. a strap end retainer on the terminal end, the strap end retainer having a retainer body with opposing retainer arms:

(1) extending from the strap end retainer with a spacing at least substantially equal to the width of the support strap, and (2) thereafter extending inwardly toward each other with a retainer strap insertion space defined therebetween, whereby a portion of the length of the support strap can be inserted within the retainer strap insertion space to retain the portion of the length between the retainer arms and the retainer body.

13. The strap end retainer of claim 12 wherein the strap end retainer:

a. is formed of resiliently flexible material, and b. surrounds at least a substantial portion of the circumference of the support strap at its terminal end.

14. The suspension training device of claim 1 wherein the grip includes:

a. an elongated rigid handle extending between opposing handle ends, the handle being configured to be comfortably gripped within a user's hand;

b. handle straps, each handle strap extending from one of the handle ends;

c. an arch extending between opposing arch ends, each arch end:

(1) extending from one of the handle straps, and (2) being spaced from the handle.

15. The suspension training device of claim 14 wherein the grip further includes a pair of rigid spacers, each spacer having:

a. a length extending between and spacing one of the handle ends and one of the arch ends, b. one of the handle straps extending along at least a major portion of the spacer's length.

16. The suspension training device of claim 15 wherein each handle strap extends at least partially within:

a. one of the spacers, and b. the handle.

17. The suspension training device of claim 1 wherein the grip includes:

a. an elongated rigid handle extending between opposing handle ends;

b. an arch:

(1) bending along a plane spaced from the handle, and (2) extending between opposing arch ends;

c. flexible handle straps, wherein each handle strap extends from the grip:

(1) at or adjacent one of the arch ends, and
(2) spaced from the handle ends.

18. The suspension training device of claim 1 wherein the grip includes:
a. an elongated rigid handle extending between opposing handle ends;
b. a pair of rigid spacers, each spacer extending from one of the handle ends at an at least substantially perpendicular angle with respect to the handle;
c. an arch:
(1) bending along a plane spaced from the handle, and
(2) extending between opposing arch ends, each arch end being joined to one of the spacers.

19. The suspension training device of claim 1 wherein the grip includes:
a. an elongated handle extending between opposing handle ends, the handle being configured to be comfortably gripped within a user's hand;
b. a pair of spacers, each spacer extending from one of the handle ends at a substantially perpendicular angle with respect to the handle;
c. an arch:
(1) extending between opposing arch ends extending from the spacers, and
(2) bending along a plane spaced from the handle.

20. The suspension training device of claim 1 wherein the grip includes:
a. an elongated handle extending between opposing handle ends;
b. a pair of rigid spacers, each spacer;
(1) extending at an angle from one of the handle ends, and
(2) having a flexible handle strap extending therefrom;
c. an arch:
(1) extending between the spacers, and
(2) bending along a plane spaced from the handle.

21. The suspension training device of claim 20 further including:
a. a bridge member having a pair of bridge apertures defined therein,
wherein the bridge apertures are each configured to:
i. flex to receive the mounting button therein, and
ii. thereafter collapse to prevent the withdrawal of the mounting button
wherein the mounting button:
(1) has a cross-sectional area great than that of the support strap, and
(2) is at least substantially rigid.

22. The suspension training device of claim 1 wherein the grip includes:
a. an elongated handle extending between opposing handle ends, and
b. a pair of elongated handle straps wherein:
(1) each handle strap extends from the grip at or adjacent to one of the handle ends;
(2) each handle strap has:
(a) a thickness oriented perpendicular to the length of the handle strap, and
(b) a width oriented perpendicular to the length and thickness of the handle strap, wherein the width is at least twice as great as the thickness;
wherein the handle strap has opposing handle strap faces defined across the width and length of the handle strap, with the opposing handle strap faces being spaced by the handle strap thickness;
(3) the width of each handle strap folds over upon itself as the handle strap approaches the handle; and
(4) the handle straps are joined to the support strap with the handle strap faces oriented at least substantially parallel to each other as the handle straps approach the support strap.

23. The suspension training device of claim 1 wherein:
a. a pair of elongated handle straps extend between the grip and the support strap;
b. each handle strap has opposing handle strap faces spaced by a handle strap thickness about the circumference of the handle strap, and wherein the handle strap thickness defines less than a third of the circumference of the handle strap;
c. the handle straps are:
(1) situated at least substantially in abutment to each other,
(2) with their handle strap faces being oriented at least substantially parallel to each other,
as the handle straps extend from the support straps;
d. the handle straps twist about their lengths as they extend between the support straps and the grip; and
e. the handle straps are:
(1) distantly spaced,
(2) with theft handle strap faces being oriented toward each other, as the handle straps extend from the grip.

24. The suspension training device of claim 23 wherein each handle strap face is folded over as the handle straps extend from the grip.

25. A suspension training device in combination with an anchor, the suspension training device including:
a. an elongated support strap,
b. a grip situated at an end of the support strap, and
c. a mounting button situated on the support strap at a second end of the support strap, opposite the end at which the grip is situated;
wherein the anchor includes:
a. an anchor rear face configured for affixment to a surface;
b. an anchor front face; and
c. anchor tongues extending in opposing directions from opposing sides of the anchor front face to terminate in free ends, the anchor tongues having lengths which are:
(1) closely spaced adjacent each other to define an anchor strap insertion slot therebetween, and
(2) closely spaced adjacent the anchor front face to define an anchor strap mounting passage between the anchor tongues and the anchor front face,
whereby a portion of the length of the support strap can be inserted within the anchor strap insertion slot to retain the portion within the anchor strap mounting passage.

26. A suspension training device including:
a. an elongated flexible support strap;
b. a grip affixed to an end of the support strap;
c. a rigid mounting button
(1) situated on the support strap at a second end, opposite the end at which the grip is situated, and
(2) configured such that the mounting button can pivot with respect to the support strap between:
(a) a first orientation wherein the mounting button has a first cross-sectional area measured along a plane perpendicular to the length of the support strap extending from the mounting button, and
(b) a second orientation wherein the mounting button has a second cross-sectional area measured along a plane perpendicular to the length of the support strap extending from the mounting button, the second cross-sectional area being at least twice the first cross-sectional area;

d. a loop situated along the support strap, the loop:

(1) being sized to allow insertion of:

(a) the mounting button in the first orientation, and (b) a portion of the support strap adjacent the mounting button, through the loop, (2) being configured to collapse unless urged open by a user, whereby the inserted mounting button resists withdrawal from the loop unless the loop is urged open by the user.

* * * * *